United States Patent [19]

Yamato

[11] Patent Number: 4,508,085

[45] Date of Patent: Apr. 2, 1985

[54] FUEL INJECTION CONTROL METHOD FOR MULTI CYLINDER INTERNAL COMBUSTION ENGINES OF SEQUENTIAL INJECTION TYPE AT ACCELERATION

[75] Inventor: Akihiro Yamato, Shiki, Japan

[73] Assignee: Honda Motor Co., Ltd., Tokyo, Japan

[21] Appl. No.: 605,681

[22] Filed: Apr. 30, 1984

[30] Foreign Application Priority Data

Jun. 15, 1983 [JP] Japan ..... 58-107547

[51] Int. Cl.[3] ..... F02M 51/00

[52] U.S. Cl. ..... 123/492

[58] Field of Search ..... 123/492, 493

[56] References Cited

U.S. PATENT DOCUMENTS

| | | | |
|---|---|---|---|
| 4,184,458 | 1/1980 | Aoki et al. | 123/492 |
| 4,424,568 | 1/1984 | Nishimura et al. | 123/492 |
| 4,434,769 | 3/1984 | Otobe et al. | 123/492 |
| 4,457,283 | 7/1984 | Kobayashi et al. | 123/492 |

FOREIGN PATENT DOCUMENTS

| | | | |
|---|---|---|---|
| 0025534 | 2/1983 | Japan | 123/492 |
| 0048730 | 3/1983 | Japan | 123/492 |

*Primary Examiner*—Parshotam S. Lall

*Attorney, Agent, or Firm*—Arthur L. Lessler

[57] ABSTRACT

A method of sequentially injecting fuel into the cylinders of a multi cylinder internal combustion engine in predetermined sequence in synchronism with generation of pulses of a trigger signal, wherein the quantity of fuel to be injected into each cylinder is set to a value appropriate to an operating condition of the engine then detected, upon generation of each pulse of the same signal. When an accelerating condition of the engine is detected, an acceleration fuel increment is set at the time of generation of a present pulse of the trigger signal, and an additional injection of the set acceleration fuel increment is effected into a cylinder into which one of the sequential injections was effected at the time of generation of a preceding pulse of the trigger signal. The acceleration fuel increment is preferably set to a value corresponding to the difference between a fuel injection quantity set at the time of generation of a present pulse of the trigger signal and a fuel injection quantity supplied to the engine at the time of generation of a preceding pulse of the same signal.

6 Claims, 9 Drawing Figures

THREE-WAY CATALYST
13
12
1a
CYLINDERS
1
INTERNAL COMBUSTION ENGINE
CYL SENSOR
10
Ne SENSOR
9
Tw SENSOR
11
ECU
5
FUEL INJECTION VALVES
6
2
7
PBA SENSOR
8
3(3')
THROTTLE BODY
4
θth SENSOR 5
4
θth SENSOR
8
PBA SENSOR
11
Tw SENSOR
10
CYL SENSOR
9
Ne SENSOR
504
LEVEL SHIFTER UNIT
505
MULTI-PLEXER
506
A/D
501
WAVEFORM SHAPER
502
Me COUNTER
503
CPU
512
507
ROM
508
RAM
509
OUTPUT COUNTERS
510
DRIVING CIRCUITS
6a1
6a2
6a3
6a4

TACC
TACCn
0
0
G+
Δθn
Δθ

TPACC
TPACCn
N2
0
NPACC

FUEL INJECTION CONTROL METHOD FOR MULTI CYLINDER INTERNAL COMBUSTION ENGINES OF SEQUENTIAL INJECTION TYPE AT ACCELERATION

BACKGROUND OF THE INVENTION

This invention relates to a fuel injection control method for multi cylinder internal combustion engines of the sequential injection type, and more particularly to a method of this kind which is adapted to eliminate a time lag in the supply of increased fuel to such engines at acceleration thereof for improvement of the accelerability of the engines.

In order to always achieve good operating characteristics of an internal combustion engine such as driveability, it is generally employed to detect operating conditions of the engine, determine a fuel quantity required for the detected operating condition of the engine, and supply through injection the determined quantity of fuel to the engine by means of a fuel metering system such as fuel injection valves. Fuel injection into each cylinder of the engine should be started earlier than the start of a suction stroke of the cylinder by such a period of time as to permit all the required quantity of fuel to be supplied to the cylinder even when the engine is operating in a high speed region where the valve opening period of the intake valve is small, taking into account the time required for injected fuel to form a mixture with intake air, the time required for the mixture to travel from a location of its formation in the vicinity of the fuel injection valve to the interior of the cylinder, etc.

However, if the above period of time is set to too large a value, there can occur a considerable time lag between detection of an accelerating condition of the engine and delivery of a required increased quantity of fuel into the cylinder in a low speed region of the engine in particular, thus degrading the responsiveness of the engine to the accelerating action of the driver.

To avoid such disadvantage, a method has been proposed e.g. by Japanese Provisional patent publication (Kokai) No. 58-202335, which comprises detecting whether or not the engine is in an accelerating condition, in synchronism with generation of each pulse of a control signal having a constant pulse repetition period and asynchronous with the rotation of the engine, and injecting accelerating additional fuel into all the cylinders of the engine upon detection of an accelerating condition of the engine. According to this proposed method of supplying all the cylinders with the same quantity of additional fuel, it is impossible to adjust the quantities of additional fuel to be supplied to individual cylinders. Consequently, some cylinders can become short of accelerating fuel, while other cylinders can be supplied with an excessive quantity of accelerating fuel, resulting in degraded emission characteristics of the engine.

SUMMARY OF THE INVENTION

It is the object of the invention to provide a fuel injection control method for a multi cylinder internal combustion engine of the sequential injection type, which is adapted to improve the responsiveness of the engine in transition to an accelerating condition, and is capable of accurately controlling the quantity of fuel being supplied to each of the cylinders at acceleration to a value individually required by the cylinder, to thereby prevent deterioration of the emission characteristics of the engine.

The present invention provides a method of controlling the supply of fuel to an internal combustion engine having a plurality of cylinders at acceleration thereof, wherein operating conditions of the engine are detected, the quantity of fuel being supplied to the engine is set to a value appropriate to the detected operating condition of the engine upon generation of each pulse of a trigger signal, and sequential injections of the set quantity of fuel are effected into the cylinders in predetermined sequence in synchronism with generation of pulses of the trigger signal.

The method according to the invention is characterized by comprising the following steps: (1) determining whether or not the engine is operating in an accelerating condition; (2) setting an acceleration fuel increment at the time of generation of a present pulse of the trigger signal, when it is determined that the engine is operating in the accelerating condition; and (3) effecting an additional injection of the set acceleration fuel increment into one of the engine cylinders into which one of the above sequential injections was effected at the time of generation of a preceding pulse of the same signal.

Preferably, the sequential injections are each started at a crank angle position of the engine falling within a range from 30 to 180 degrees before the start of a suction stroke of a corresponding one of the engine cylinders. Also preferably, when it is determined in the step (1) that the engine is operating in the accelerating condition, a determination is made as to whether or not the above one of the sequential fuel injections is still being effected into the above one cylinder into which the additional fuel injection is to be effected, at the time of generation of the present pulse of the trigger signal. If the fuel injection is still being effected, the additional fuel injection is prohibited. Also, preferably, when the rotational speed of the engine is higher than a predetermined value, the additional fuel injection is also prohibited.

Preferably, the acceleration fuel increment is set to a value corresponding to the difference between a fuel injection quantity for one of the above sequential fuel injections set at the time of generation of a present pulse of the trigger signal and a fuel injection quantity supplied to the engine as another one of the sequential fuel injections at the time of generation of a preceding pulse of the same signal. The additional fuel injection is effected only when the above difference is larger than a predetermined value.

The above and other objects, features and advantages of the invention will be more apparent from the ensuing detailed description taken in conjunction with the accompanying drawings.

DETAILED DESCRIPTION

The present invention will now be described in detail with reference to the drawings.

Figure 1:
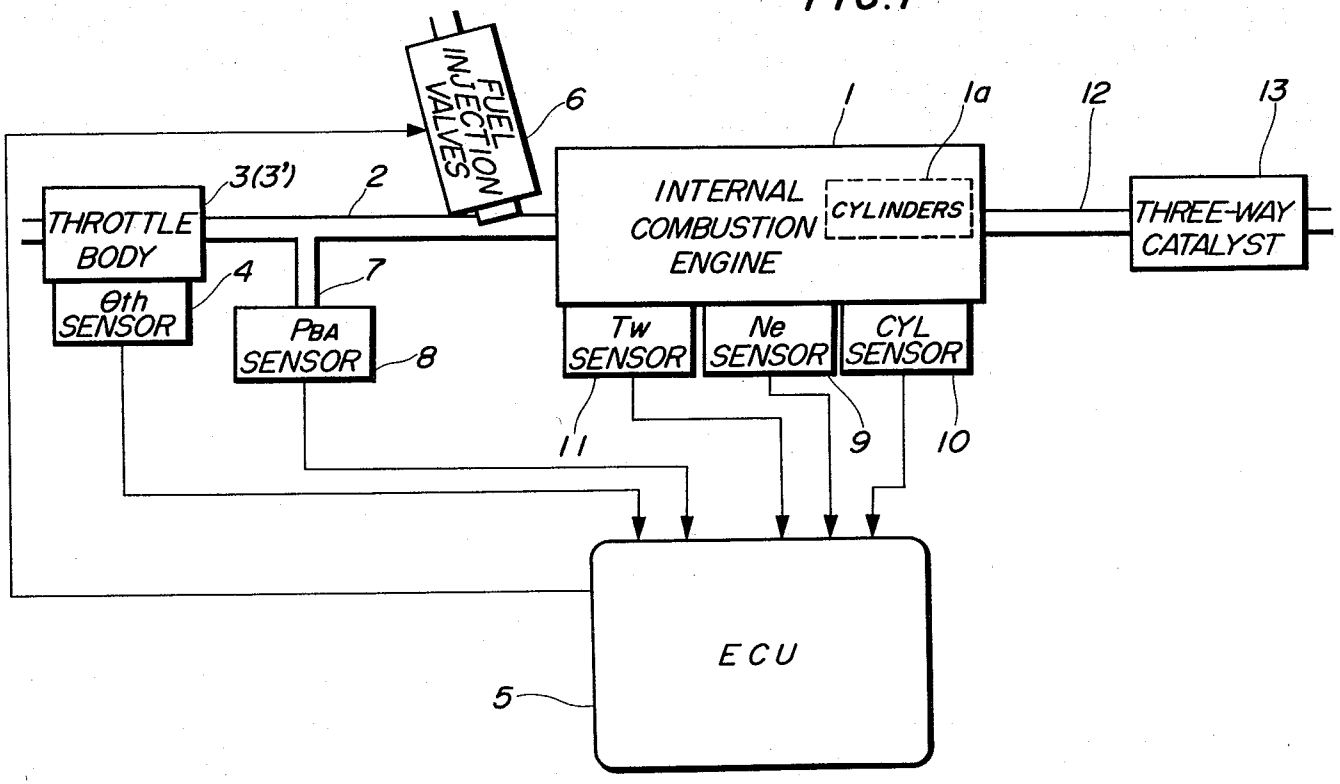
FIG. 1 is a block diagram of the whole arrangement of a fuel supply control system to which is applicable the method according to the invention.

Referring first to FIG. 1, there is illustrated an example of the whole arrangement of a fuel supply control system for internal combustion engines, to which the method according to the present invention is applicable. Reference numeral 1 designates a multi cylinder internal combustion engine of the sequential injection type which has four cylinders 1*a* for instance, and to which is connected an intake pipe 2 with a throttle valve 3 in a throttle body 3 arranged thereacross. A throttle valve opening ($\theta$TH) sensor 4 is connected to the throttle valve 3' for detecting its valve opening and is electrically connected to an electronic control unit (hereinafter called "the ECU") 5, to supply same with an electrical signal indicative of throttle valve opening detected thereby.

Fuel injection valves 6 are arranged in the intake pipe 2 each at a location slightly upstream of an intake valve, not shown, of a corresponding one of the engine cylinders 1*a*, and between the engine 1 and the throttle valve 3', for supplying fuel into the corresponding engine cylinder. The fuel injection valves 6 are connected to a fuel pump, not shown, and electrically connected to the ECU 5, in a manner having their valve opening periods or fuel injection quantities controlled by driving signals supplied from the ECU 5.

On the other hand, an absolute pressure (PBA) sensor 8 communicates through a conduit 7 with the interior of the intake pipe 2 at a location immediately downstream of the throttle valve 3'. The absolute pressure sensor 8 is adapted to detect absolute pressure in the intake pipe 2 and supplies an electrical signal indicative of detected absolute pressure to the ECU 5.

An engine rpm sensor (hereinafter called "the Ne sensor") 9 and a cylinder-discriminating sensor (hereinafter called "the CYL sensor") 10 are arranged on a camshaft, not shown, of the engine 1 or a crankshaft of same, not shown. The former 9 is adapted to generate one pulse at a particular crank angle each time the engine crankshaft rotates through 180 degrees, while the latter 10 is adapted to generate one pulse at a particular crank angle of a particular engine cylinder. The above pulses generated by the sensors 9, 10 are supplied to the ECU 5.

An engine cooling water temperature (TW) sensor 11, which may be formed of a thermistor or the like, is mounted in the cylinder block of the engine 1 in a manner embedded in the peripheral wall of an engine cylinder having its interior filled with cooling water, an electrical output signal of which is supplied to the ECU 5 as an engine temperature signal.

An intake air temperature sensor, not shown, is arranged in the intake pipe 2, for supplying an electrical signal of detected intake air temperature to the ECU 5. A three-way catalyst 13 is arranged in an exhaust pipe 12 extending from the main body of the engine 1 for purifying ingredients HC, CO and NOx contained in the exhaust gases. An $O_2$ sensor, not shown, is inserted in the exhaust pipe 12 at a location upstream of the three-way catalyst 13 for detecting the concentration of oxygen in the exhaust gases and supplying an electrical signal indicative of a detected concentration value to the ECU 5.

Further connected to the ECU 5 are a sensor for detecting atmospheric pressure (PA) and a starter switch for actuating the starter of the engine 1, neither of which is shown, for supplying an electrical signal indicative of detected atmospheric pressure and an electrical signal indicative of its own on and off positions to the ECU 5, respectively.

The ECU 5 operates on the basis of the various engine parameter signals inputted thereto to determine operating conditions of the engine including an accelerating conditions, and to calculate the valve opening period TOUT of the fuel injection valves 6 in response to the determined engine operating conditions by means of the following equation:

$$TOUT = Ti \times K1 + TACC \times K2 + K3 \quad (1)$$

wherein Ti represents a basic value of the fuel injection period of the fuel injection valves 6 and is calculated as a function of the intake pipe absolute pressure PBA and the engine rpm Ne, TACC represents a fuel increment applied at acceleration of the engine, hereinafter explained, and K1, K2 and K3 represent correction coefficients and variables having their values calculated, by respective predetermined equations, on the basis of the values of signals from the aforementioned various sensors, that is, the throttle valve opening ($\theta$TH) sensor 4, the intake pipe absolute pressure sensor 8, the Ne sensor 9, the engine temperature (TW) sensor 11, the intake air temperature sensor, the atmospheric pressure sensor, etc., so as to optimize the startability, emission characteristics, fuel consumption, accelerability, etc. of the engine.

The ECU 5 supplies driving signals to the fuel injection valves 6 to open same for the valve opening period TOUT calculated in the above manner.

Figure 2:
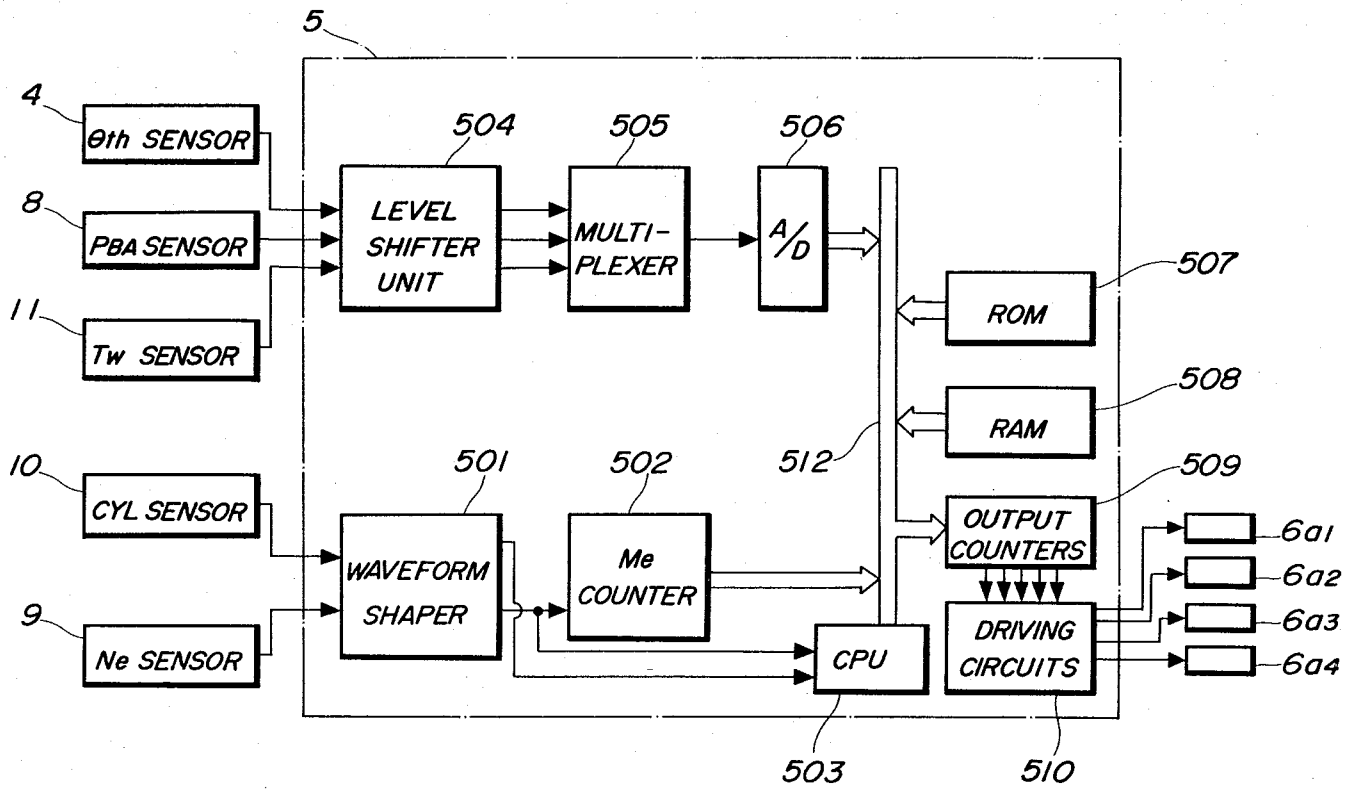
FIG. 2 is a block diagram of the internal arrangement of an electronic control unit appearing in FIG. 1.

FIG. 2 shows an electrical circuit within the ECU 5 in FIG. 1. The TDC signal and the cylinder-discriminating signal, respectively, from the Ne sensor 9 and the CYL sensor 10 in FIG. 1 are supplied to a waveform shaper 501 to have their waveforms shaped. The former signal is supplied to a central processing unit (hereinafter called "the CPU") 503 as well as to an Me counter, while the latter signal is supplied to the CPU 503 alone. The Me counter 502 counts the interval of time between a preceding pulse of the TDC signal and a present pulse of the same signal, and accordingly its counted value Me is proportional to the reciprocal of the actual engine rpm Ne. The Me counter 502 supplies the counted value Me to the CPU 503 via a data bus 510.

The respective output signals from the throttle valve opening ($\theta$TH) sensor 4, the intake pipe absolute pressure (PBA) sensor 8, the engine temperature (TW) sensor 11, all appearing in FIG. 1, and other engine parameter sensors have their voltage levels shifted to a predetermined voltage level by a level shifter unit 504 and successively applied to an analog-to-digital converter (hereinafter called "the A/D converter") 506 through a multiplexer 505. The A/D converter 506 successively converts the above signals into digital signals and supplies them to the CPU 503 via the data bus 512.

Also connected to the CPU 503 are a read-only memory (hereinafter called "the ROM") 507, a random access memory (hereinafter called "the RAM") 508, and an output counter 509, through the data bus 512. The RAM 508 temporarily stores the resultant values of various calculations from the CPU 503, etc., while the ROM 507 stores a control program executed by the CPU 503, a basic fuel injection period Ti map for the fuel injection valves 6, values of coefficients and variables corresponding to values of various engine operation parameters, etc.

The CPU 503 executes the control program stored in the ROM 507 in synchronism with generation of pulses of the TDC signal to calculate the valve opening period TOUT for the fuel injection valves 6, as well as the valve opening period TOUT' for additional fuel injection, hereinafter referred to, by the use of values of coefficients and variables read from the ROM 507 in response to the various engine parameter signals referred to before. Almost upon completion of each calculation of the TOUT value, the CPU 503 applies the calculated TOUT value as a preset value to a corresponding one of output counters 509 formed of down counters via the data bus 512. The output counters 509 are thus successively preset in predetermined sequence in synchronism with generation of pulses of the TDC signal, and upon being preset, each output counter 509 starts to operate and continue to generate a control signals until its count becomes zero. The driving circuits 510 sequentially supply driving signals to the respective fuel injection valves **6*a*1–6*a*4 to open same in predetermined sequence, as long as they are supplied with the above control signals from the respective output counters 509. Illustration of a data address bus and a control bus connecting between the CPU 503 and the Me value counter 502, the A/D converter 506, the ROM 507, the RAM 508 and the output counters 509 is omitted from FIG. 2**.

Figure 3:
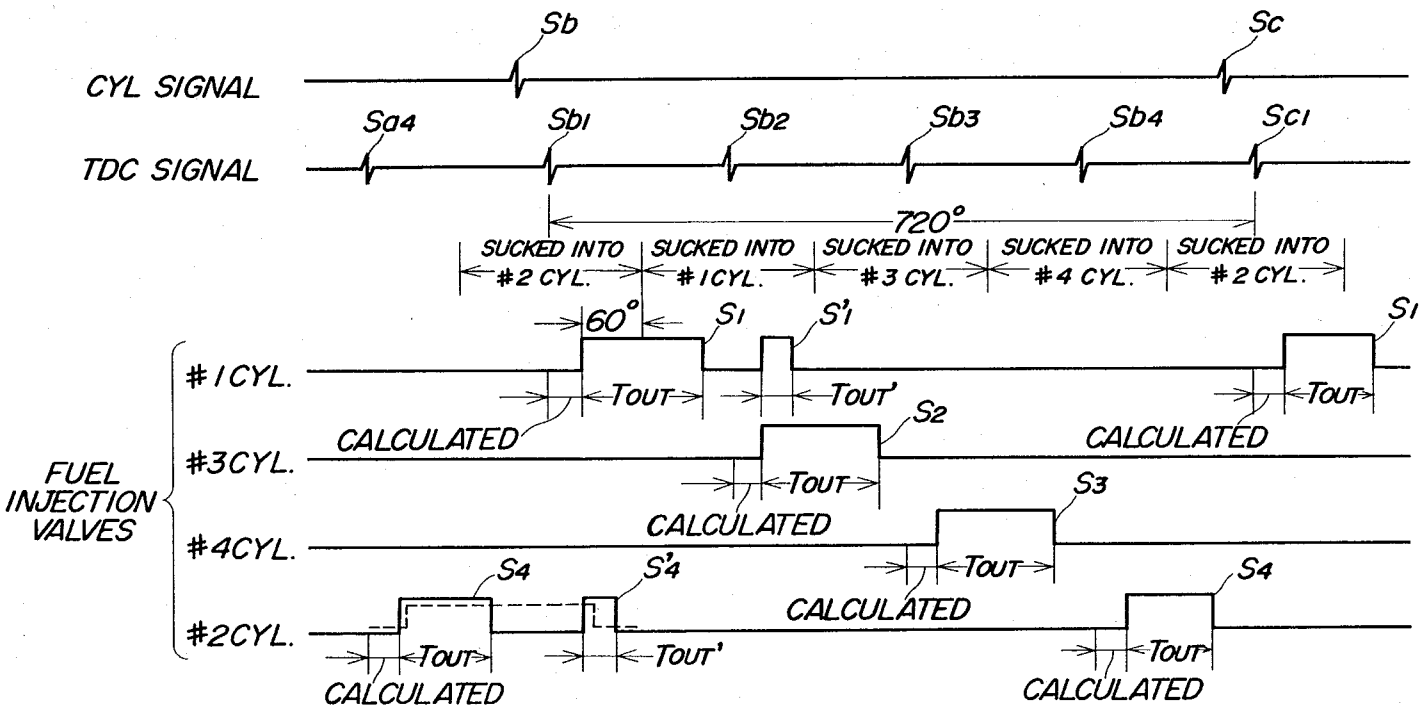
FIG. 3 is a timing chart showing the relationship in timing between a cylinder-discriminating signal, a TDC signal, and driving signals for fuel injection valves, and also showing the manner of effecting additional injections of acceleration fuel increments, which is applied at acceleration of the engine, according to the method of the invention.

FIG. 3 shows the timing relationship between the cylinder-discriminating signal and the TDC signal, which are inputted to the ECU 5 in FIGS. 1 and 2, and the driving signals for the fuel injection valves **6*a*1–6*a*4. A pulse of the cylinder-discriminating signal is inputted to the ECU each time the engine rotates through a crank angle of 720 degrees as indicated by the symbols Sb and SC in FIG. 3**, while a pulse of the TDC signal is inputted to the ECU each time the engine rotates through a crank angle of 180 degrees as indicated by the symbols S*a*4–S*c*1 in FIG. 3. The timing of outputting of the driving signals S1–S4 for the fuel injection valves is set in dependence on the timing relationship between the cylinder-discriminating signal and the TDC signal. After each pulse of the cylinder-discriminating signal has been generated, driving signals are sequentially generated from the driving circuits 510 for supply of fuel to first, third, fourth and second cylinders in synchronism with generation of respective pulses of the TDC signal immediately following the generation of the above pulse of the cylinder-discriminating signal.

The control program is so adapted that the supply of each driving signal is started when the piston in the corresponding cylinder is in a position in advance of its top-dead-center position by a predetermined crank angle falling within a range between 30 and 180 degrees, preferably between 60 and 90 degrees. The predetermined crank angle is set to a value dependent upon the time required for calculation of the fuel injection period TOUT, the timing of starting the opening of the intake valve with respect to the top-dead-center position, the time lag between the time the fuel injection valve starts to open and the time the resultant mixture is sucked into the corresponding cylinder, etc.

Figure 4:
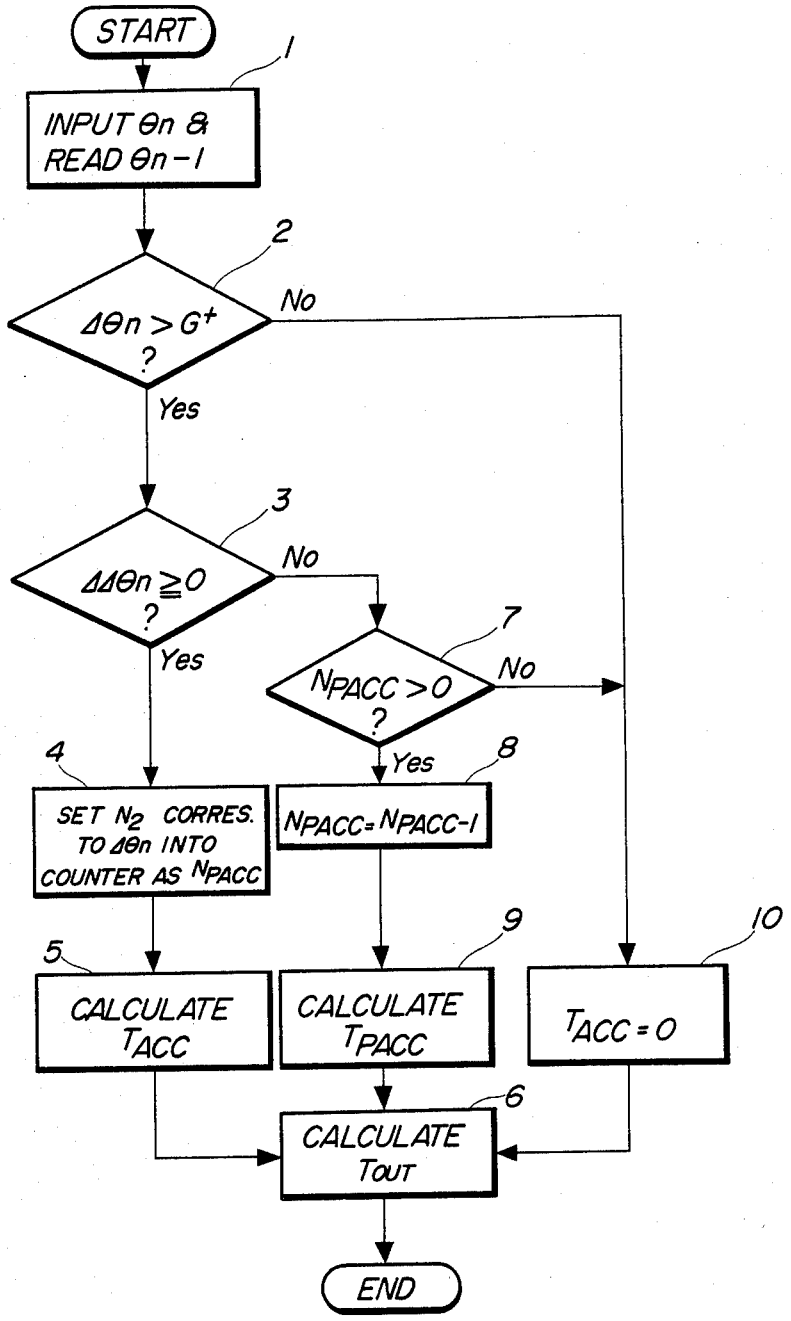
FIG. 4 is a flow chart of a subroutine for calculating an acceleration fuel increment TACC applied for calculation of the fuel injection period TOUT of each fuel injection valve for ordinary fuel injection.

FIG. 4 shows a flow chart of a subroutine for calculating the acceleration fuel increment TACC, which is executed within the CPU 503 in FIG. 2. First, upon inputting of a present pulse of the TDC signal to the CPU in the present loop, a detected value $\theta n$ of the throttle valve opening $\theta$TH is read into the CPU, and simultaneously a value $\theta n-1$ of same which was read and stored upon inputting of a preceding pulse of the TDC signal in the last loop is read from the RAM 508 (step 1). Then, a difference $\Delta\theta n$ ($=\theta n-\theta n-1$) between the two values $\theta n$ and $\theta n-1$ is calculated, and it is determined at the step 2 whether or not the calculated difference is larger than a positive predetermined value G+ for acceleration synchronous with generation of the TDC signal. If the answer to the question of the step 2 is yes, a calculation is made of a difference $\Delta\Delta\theta n$ between the above difference $\Delta\theta n$ and a difference $\Delta\theta n-1$ obtained in the last loop, and it is determined whether or not the calculated difference $\Delta\Delta\theta n$ is equal to or larger than zero to determine whether the engine is operating in an accelerating condition or in a post-acceleration condition, at the step 3. If the answer to the question of the step 3 is yes, it is determined that the engine is operating in an accelerating condition, whereas if the answer is no, it is determined that the engine is operating in a post-acceleration condition.

If it is determined in the step 3 that the engine is operating in an accelerating condition, a post-acceleration fuel increasing pulse number N2 is selected from a table stored in the ROM 507, which corresponds to the variation $\Delta\theta n$ of the throttle valve opening, and set into a post-acceleration counter within the RAM 508 as a count NPACC, at the step 4. This set pulse number or count NPACC is thereafter updated to a new value corresponding to the variation $\Delta\theta n$ of the throttle valve opening, each time the step 4 is executed in each of the following loops as a result of the answer to the step 3 becoming yes. A value of the acceleration fuel increment TACC is read from a table stored in the ROM 507, which corresponds to the variation $\Delta\theta$ of the throttle valve opening, at the step 5.

Figures 5, 6:
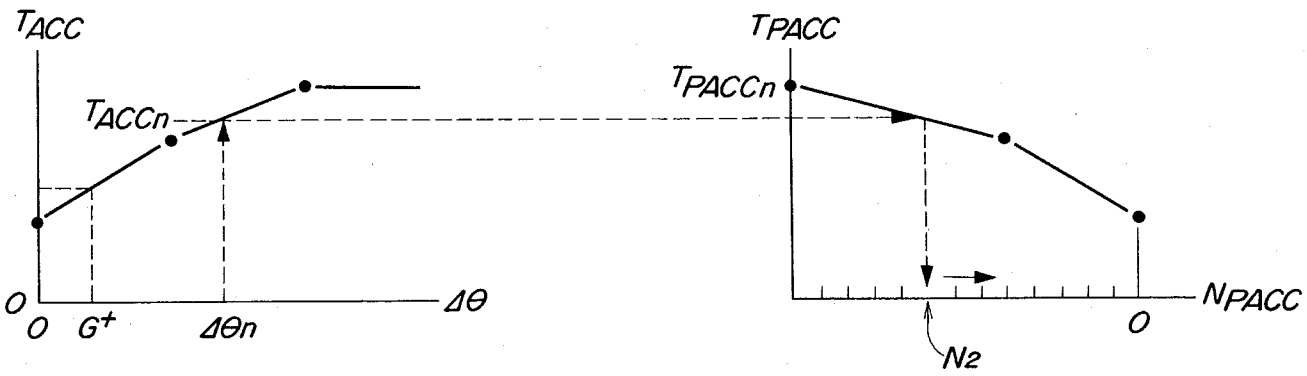
FIG. 5 is a graph showing a table of variation $\Delta\theta n$ in the throttle valve opening and acceleration fuel increment TACC.
FIG. 6 is a graph showing a table of a number NPACC of pulses of the TDC signal counted after acceleration of the engine and post-acceleration fuel increment TPACC.

FIGS. 5 and 6 show tables, respectively, of the relationship between the variation $\Delta\theta n$ of the throttle valve opening and the acceleration fuel increment TACC, and the relationship between the count NPACC and the post-acceleration fuel increment TPACC. A value TACCn of the acceleration fuel increment TACC is determined from the table of FIG. 5, which corresponds to the variation $\Delta\theta n$. Then, a value TPACCn of the post-acceleration fuel increment TPACC is determined from the table of FIG. 6, which corresponds to the value TACCn determined above, followed by determining the value of the post-acceleration fuel increasing pulse number N2 from the value TPACCn determined. Thus, according to FIGS. 5 and 6, the larger the throttle valve opening variation $\Delta\theta n$, the larger the post-acceleration fuel increment TPACC is. Further, the larger the throttle valve opening variation $\Delta\theta n$, the larger value the post-acceleration count NPACC is set to, so as to obtain a longer fuel increasing period of time.

Then, the value of the acceleration fuel increment TACC determined at the step 5 is applied to the aforementioned equation (1) to calculate the valve opening period TOUT of the fuel injection valves 6 at the step 6.

On the other hand, if it is determined in the step 3 that the engine is operating in a post-acceleration condition, it is then determined at the step 7 whether or not the post-acceleration count NPACC set into the counter in the step 4 is larger than zero. If the answer is yes, 1 is deducted from the same count at the step 8, and a value of the post-acceleration fuel increment TPACC is read from the table of FIG. 6, which corresponds to the count NPACC thus updated, at the step 9. This selected value TPACC is substituted for the value TACC in the equation (1) to calculate the fuel injection period TOUT, at the step 6.

If the answer to the question of the step 2 or the step 7 is no, the value of the fuel increment TACC is set to zero at the step 10, and then the program proceeds to the step 6 to calculate the fuel injection period TOUT.

Figure 7:
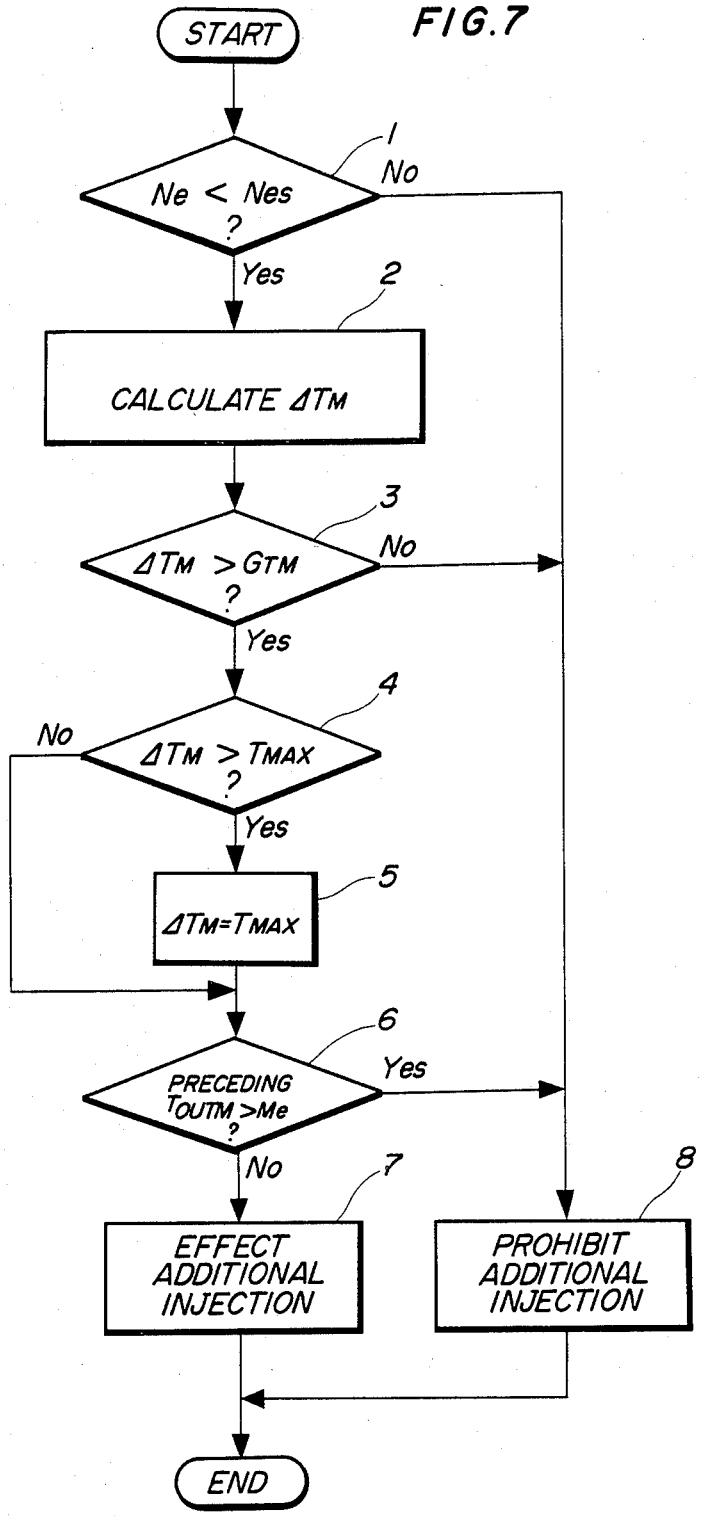
FIG. 7 is a flow chart of a manner of effecting additional fuel injection according to the method of the invention.

FIG. 7 shows a flow chart of a subroutine for executing additional fuel injection at acceleration of the engine, according to the invention. During execution of the subroutine of FIG. 4 in synchronism with generation of the TDC signal, if an accelerating condition of the engine is detected for the first time, for instance, at the time of generation of a pulse Sb1 of the TDC signal in FIG. 3, the ECU 5 sets the fuel injection period of one of the fuel injection valves 6 corresponding to the first cylinder to a corrected value increased by the acceleration fuel increment TACC as previously stated, and at the same time calls the present subroutine for execution of additional fuel injection. First, in the step 1 of FIG. 7, it is determined whether or not the engine rpm Ne is smaller than a predetermined value Nes. This predetermined value Nes is set at a value below which the engine requires additional fuel injection according to the invention for improvement of the accelerability of the engine, i.e. responsiveness of the engine to an accelerating requirement thereof. For instance, it is set at 1800 rpm. If the engine rpm Ne is higher than or equal to the predetermined value Nes (1800 rpm), the execution of the present program is terminated at the step 8, without executing the additional fuel injection according to the invention, since at such high engine speed, required acceleration-responsiveness of the engine can be achieved only by increasing the fuel injection quantity TOUT by the acceleration fuel increment TACC and the post-acceleration fuel increment TPACC alone shown in FIG. 3. If in the step 1 it is determined that the engine rpm Ne is smaller than the predetermined value Nes (e.g. 1800 rpm), the program proceeds to the step 2 wherein calculation is made of the difference $\Delta TM$ between a value of the fuel injection period TOUT for the fuel injection valve corresponding to the first cylinder calculated at the time of generation of the present pulse Sb1 of the TDC signal and a value of the fuel injection period TOUT for the fuel injection valve corresponding to the second cylinder calculated at the time of generation of the preceding pulse Sa4 of the TDC signal. The calculated difference value $\Delta TM$ is compared with a predetermined small value GTM at the step 3. This predetermined small value GTM is provided to determine whether or not the additional fuel injection, hereinafter described in detail, should be effected to improve the accelerability of the engine. If the difference value $\Delta TM$ is smaller than the predetermined value GTM, the execution of the present subroutine is immediately terminated without executing the additional fuel injection, at the step 8.

On the other hand, if the difference value $\Delta TM$ is larger than the predetermined value GTM, the program proceeds to the step 4, wherein it is determined whether or not the difference value $\Delta TM$ is larger than a predetermined upper limit value TMAX. If the answer is yes, the difference value $\Delta TM$ is set to the same upper limit value TMAX, and then the step 6 is executed, while if the answer is no, the program directly proceeds to the step 6. The upper limit value TMAX for comparison with the difference value $\Delta TM$ is provided for the following reason: The difference value $\Delta TM$ is applied for calculation of the fuel injection period TOUT' of the fuel injection valves for the additional fuel injection according to the invention, as hereinafter described. If the difference value $\Delta TM$ is larger than the upper limit value TMAX, the resultant calculated value of fuel injection period TOUT' can be correspondingly large such that the resultant additional fuel injection still lasts even after the piston in the corresponding cylinder has finished its suction stroke. As a consequence, an excessively rich mixture can be sucked into the same cylinder during the next suction stroke, badly affecting the driveability and emission characteristics of the engine. The upper limit value TMAX is provided to avoid this disadvantage.

In the step 6, a determination is made as to whether or not the TOUT value (at S4) calculated at the time of generation of the preceding pulse Sa4 of the TDC signal is larger than the value Me indicative of the time interval of the TDC signal pulses, i.e., between Sa4 and Sb1, obtained by the Me value counter 502 in FIG. 2 at the time of generation of the present pulse Sb1 of the TDC signal. If the determination of the step 6 gives a negative answer, that is, if an ordinary fuel injection which was started upon generation of the preceding TDC signal pulse Sa4 has already been completed before the generation of the present TDC signal pulse Sb1, the program proceeds to the step 7 wherein the fuel injection period TOUT' for the additional fuel injection is calculated by the following equation, and an additional fuel injection is executed according to the calculated TOUT' value:

$$TOUT' = \Delta TM \times Ks + Tv + \Delta Tv \quad (2)$$

where $\Delta TM$ represents the difference value between values of the fuel injection period TOUT obtained in the preceding and present loops, and Ks a correction coefficient stored beforehand in the ROM 507 in FIG. 2, whose value is set within a range between 0.5 and 2.0, for instace. Tv and $\Delta Tv$ represent, respectively, a correction value set to a value corresponding to the output voltage from a battery for supplying electric power to the fuel injection valves, and a correction value set to a value proper to the operating characteristics of fuel injection valves applied, both of them being provided to compensate for a change in the output voltage from the battery. The correction value ΔTv is stored beforehand in the ROM 507.

The additional fuel injection according to the invention is executed repeatedly so long as the executing conditions in the steps 1, 3 and 6 in FIG. 7 are all satisfied at the same time, at the time of generation of each pulse of the TDC signal. For example, referring again to FIG. 3, let it be assumed that an accelerating condition of the engine is detected at the time of generation of the present pulse Sb1 of the TDC signal corresponding to the first cylinder, and accordingly an additional fuel injection S'4 is executed immediately after the generation of the same pulse Sb1. If it is determined that the engine is still in the accelerating condition at the time of generation of the next pulse Sb2 of the TDC signal corresponding to the third cylinder, while all the executing conditions in the steps 1, 3 and 6 are then satisfied, an additional fuel injection S'1 into the first cylinder is executed immediately after the generation of the same pulse Sb2. The difference value ΔTM applied to calculation of the fuel injection period TOUT' for the coresponding fuel injection valve to execute this additional fuel injection S'1 is calculated from values of the fuel injection period TOUT for the ordinary or sequential fuel injection, calculated, respectively, at the times of generation of the next pulse Sb2 and the present pulse Sb1 of the TDC signal. In this manner, during acceleration of the engine, each corresponding cylinder is supplied with an optimum quantity of fuel appropriate to an accelerating condition in which the engine is operating, and without a substantial time lag.

If the answer to the question of the step 6 is yes, that is, if the TOUT value calculated at the time of generation of the preceding pulse Sa4 of the TDC signal is larger than the value Me obtained at the time of generation of the present pulse Sb1 such that the ordinary fuel injection into the corresponding cylinder into which fuel should be additionally be injected still lasts even at the generation of the present pulse Sb1, the program proceeds to the step 8 wherein such additional fuel injection is prohibited.

That is, in the event that one of the sequential fuel injections is still continued at the time of determining whether or not an additional fuel injection should be effected, such additional fuel injection is judged to be unnecessary, so as to avoid concurrent dual fuel injections into a cylinder.

Figure 8:
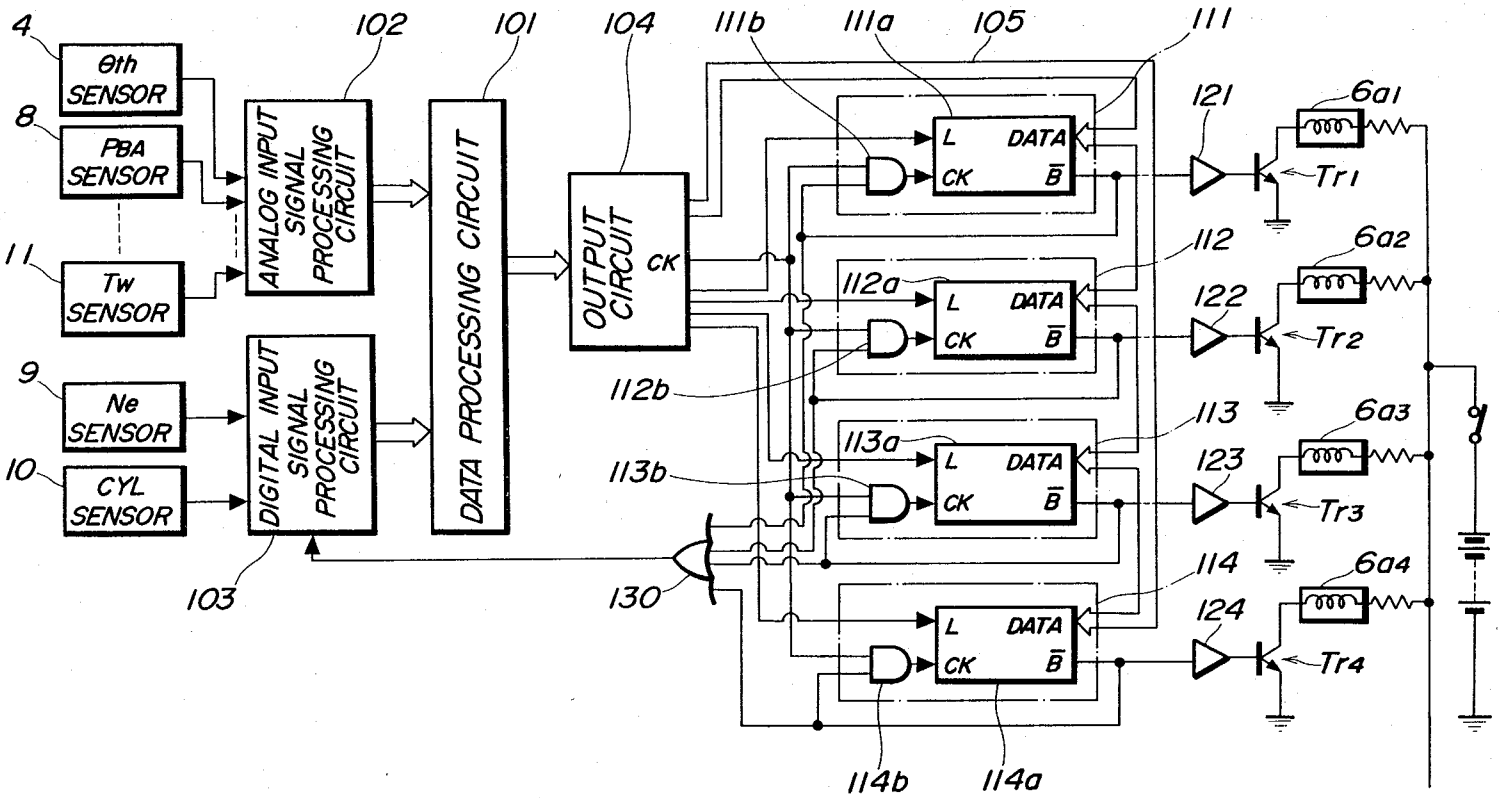
FIG. 8 is a circuit diagram of another example of the internal arrangement of the electronic control unit in FIG. 1.

FIG. 8 illustrates another example of the circuit arrangement of the ECU to which the method according to the invention is applicable. An analog input signal-processing circuit 102 is supplied with output signals from the throttle valve opening (θTH) sensor 4, the intake pipe absolute pressure (PBA) sensor 8, the engine temperature (TW) sensor 11, etc., while a digital input signal-processing circuit 103 is supplied with the TDC signal from the Ne sensor 9 and the cylinder-discriminating signal from the CYL sensor 10, and they convert these input signals into respective corresponding signals and supply same to a data processing circuit 101 which in turn operates on these digital signals and in synchronism with the TDC signal to calculate the fuel injection period TOUT for the fuel injection valves by the use of the aforementioned equation (1), and supply the resultant data of fuel injection period to an output data signal-processing circuit (hereinafter called "the output circuit") 104.

Reference numerals 111–114 designate counters which each comprise a programmable down counter 111*a*–114*a*, and an AND circuit 111*b*–114*b*. The down counters 111*a*–114*a* are disposed to be selectively supplied with loading-command signals from the output circuit 104 under command from the data processing circuit 101. For instance, if the counter 111*a* is supplied with such a loading-command signal, fuel injection period data from the output circuit 104 are loaded into the counter 111*a* through the data bus 105, to preset same. The preset value is reduced by 1 each time a clock pulse from the output circuit 104 is applied to the counter 111*a* through the AND circuit 111*b*. After the counter 111*a* has been loaded with fuel injection period data and before the preset value is reduced to zero, it continues to generate a high level output through its borrow terminal $\overline{B}$. This high level output is supplied through a buffer circuit 121 to a driving transistor Tr1 to cause same to conduct so that the corresponding fuel injection valve 6*a*1 is energized to open. When the preset value is reduced to zero (the count becomes zero), the output at the borrow terminal goes low to cause the transistor Tr1 to be cut off, and accordingly the fuel injection valve 6*a*1 is closed, and at the same time the AND circuit 111*b* with its one input connected to the borrow terminal $\overline{B}$ of the counter 111*a* is deenergized to stop the counting action.

The other counters 112–114, fuel injection valves 6*a*2–6*a*4, transistors Tr2–Tr4, and buffer circuits 122–124, which are provided for the other fuel injection valves 6*a*2–6*a*4, operate in the same manner as stated above.

The borrow terminals $\overline{B}$ of the counters 111–114 are also connected to the digital input signal-processing circuit 103 through an OR circuit 130 so that during operation of these counters the outputs through the same terminals are supplied to the circuit 103 to be converted thereby into digital signals. The digital signals are applied to the data processing circuit 101 which judges that any one of the fuel injection valves 6*a*1–6*a*4 is opened, as long as it is supplied with one of the digital signals.

With the above arrangement, if an accelerating condition of the engine is detected at the time of generation of the pulse Sb1 of the TDC signal as in the example of FIG. 3 for instance, a loading-command signal from the output circuit 104 is applied to the counter 111*a* which corresponds to the first cylinder to cause loading of data indicative of the fuel injection period TOUT for ordinary fuel injection corrected by the acceleration fuel increment TACC into the counter 111*a* as a preset value. Almost at the same time, another loading-command signal from the output circuit 104 is applied to the counter 112*a* corresponding to the second cylinder to cause loading of data indicative of the fuel injection period TOUT' for additional fuel injection into the counter 112*a* as a preset value. An ordinary fuel injection into the first cylinder and an additional fuel injection into the second cylinder are effected until the respective preset values are reduced to zero in synchronism with clock pulses applied to the respective counters 111*a*, 112*a* from the output circuit 104. On this occasion, the other counters 113*a*, 114*a* are not supplied with loading-command signals and accordingly remain inoperative. Thereafter, so long as the accelerating condition of the engine is continually detected, the respective corresponding counter circuits are operated in predetermined sequence to effect fuel injections in substantially the same manner as above.

Let it now be assumed that a fuel injection into the second cylinder in synchronism with generation of the preceding pulse Sa4 of the TDc signal is still being effected at the time of generation of the present pulse Sb1 of the TDC signal, as indicated by the broken line in FIG. 3, an output through the borrow terminal of the counter 112*a* is still supplied to the data processing circuit 101 through the OR circuit 130 and the digital input signal processing circuit 103 at the time of generation of the present pulse Sb1. As a consequence, even if an accelerating condition of the engine is then detected, the data processing circuit 101 judges it unnecessary to effect an additional fuel injection into the second cylinder, and does not output data indicative of the fuel injection period TOUT' to prohibit the same additional fuel injection.

Figure 9:
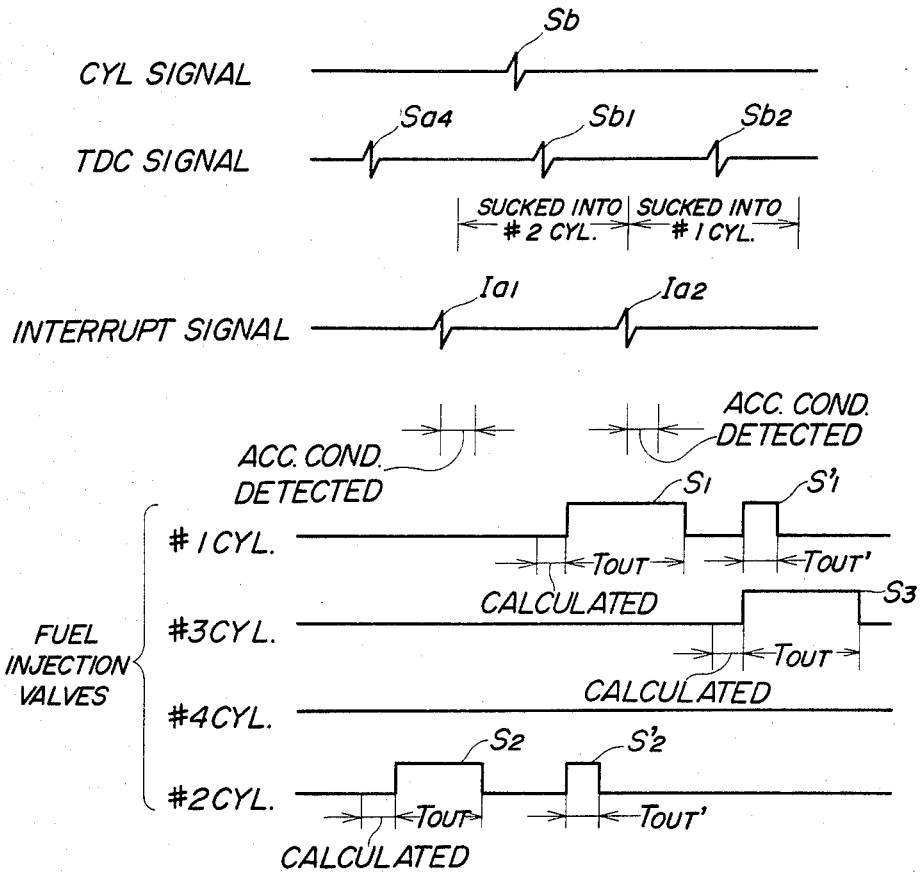
FIG. 9 is a timing chart similar to FIG. 3, showing another example of the manner of detecting an accelerating condition of the engine according to the method of the invention.

Although in the foregoing embodiment operating conditions of the engine including an accelerating condition thereof are determined in synchronism with generation of pulses of the TDC signal, an interrupt signal may alteratively be employed to detect an accelerating condition of the engine in synchronism with generation of pulses of the same signal which are each generated at a predetermined time between adjacent pulses of the TDC signal, as shown in FIG. 9. For example, in FIG. 9, if an accelerating condition of the engine is detected at the time of generation of a pulse Ia1 of the interrupt signal, the fuel injection periods TOUT, TOUT' are calculated at the time of generation of a pulse Sb1 of the TDC signal immediately following the detection of the accelerating condition of the engine. Almost upon completion of these calculations, an ordinary fuel injeciton S1 into the first cylinder and an additional fuel injection S'2 into the second cylinder are effected at the same time. If the accelerating condition of the engine is still detected at the time of generation of the next pulse Ia2 of the interrupt signal, calculations of the fuel injection periods TOUT, TOUT' are made at the time of generation of the pulse Sb2 of the TDC signal, and an ordinary fuel injection S3 into the third cylinder and an additional fuel injection S'1 into the first cylinder are effected almost upon completion of these calculations.

What is claimed is:

1. A method of controlling the supply of fuel to an internal combustion engine having a plurality of cylinders at acceleration thereof, wherein operating conditions of said engine are detected, the quantity of fuel being supplied to said engine is set to a value appropriate to the detected operating condition of said engine upon generation of each pulse of a trigger signal, and sequential injections of the set quantity of fuel are effected into said cylinders in predetermined sequence in synchronism with generation of pulses of said trigger signal, the method comprising the steps of: (1) determining whether or not said engine is operating in an accelerating condition; (2) setting an acceleration fuel increment at the time of generation of a present pulse of said trigger signal, when it is determined that said engine is operating in said accelerating condition; and (3) effecting an additional injection of fuel at the time of generation of said present pulse of said trigger signal, in a quantity corresponding to the set acceleration fuel increment into one of said cylinders into which one of said sequential injections was effected at the time of generation of a preceding pulse of said trigger signal.

2. A method as claimed in claim 1, comprising the steps of determining whether or not said one of said sequential injections is still being effected into said one of said cylinders into which said additional injection of fuel is to be effected, at the time of generation of said present pulse of said trigger signal, when it is determined in said step (1) that said engine is operating in said accelerating condition, and prohibiting effecting said additional injection of fuel if it is determined that said one of said sequential injections is still being effected.

3. A method as claimed in claim 1, wherein said sequential injections are each started at a crank angle position of said engine falling within a range from 30 to 180 degrees before the start of a suction stroke of a corresponding one of said cylinders.

4. A method as claimed in claim 1, wherein said acceleration fuel increment is set to a value corresponding to the difference between a fuel injection quantity for one of said sequential injections set at the time of generation of a present pulse of said trigger signal and a fuel injection quantity supplied to said engine as another one of said sequential injections at the time of generation of a preceding pulse of said trigger signal.

5. A method as claimed in claim 4, wherein said additional injection is effected only when said difference is larger than a predetermined value.

6. A method as claimed in any of claims 1 through 5, further comprising the steps of detecting the rotational speed of said engine, and prohibiting effecting said additional injection of fuel when the detected rotational speed of said engine is higher than a predetermined value.

* * * * *